United States Patent [19]

Clem

[11] Patent Number: 4,848,624

[45] Date of Patent: Jul. 18, 1989

[54] THIGH MOUNTABLE SMALL MODULAR PACK SYSTEM WITH DEMOUNTABLE INTERCHANGEABLE POUCHES

[76] Inventor: Ronald D. Clem, 456 Pittman, Richardson, Tex. 75081

[21] Appl. No.: 193,791

[22] Filed: May 13, 1988

[51] Int. Cl.[4] ..... A45F 3/14

[52] U.S. Cl. ..... 224/222; 224/240; 224/253; 224/267; 224/901

[58] Field of Search ..... 224/222, 235, 236, 237, 224/240, 241, 242, 253, 267, 276, 42.46 B, 901, 904,920,148, 203, 202, 252, 918, 920, 232; 150/113; 190/110; 2/94, DIG. 6

[56] References Cited

U.S. PATENT DOCUMENTS

| | | | |
|---|---|---|---|
| 1,728,365 | 9/1929 | Root et al. | 224/222 |
| 4,041,549 | 8/1977 | Atkinson | 2/94 |
| 4,303,187 | 12/1981 | Berman | 224/222 |
| 4,303,239 | 12/1981 | Walsh, Jr. | 272/119 |
| 4,424,841 | 1/1984 | Smith | 150/33 |
| 4,555,812 | 12/1985 | Akers | 2/94 |

*Primary Examiner*—Henry J. Recla
*Assistant Examiner*—Robert M. Fetsuga
*Attorney, Agent, or Firm*—Warren H. Kintzinger

[57] ABSTRACT

A pack system worn on either thigh held in place with strapping around the thigh and one or more straps connected to a waist belt. While the modular pack system can have one or more pouches it includes removeable and replaceable mounting provision for a plurality of removeable interchangeable pouches. The backplane mounting portion of the pack system on which removeable pouches are mounted is, as a maximum, approximately eight inches wide by ten inches high having adjustable leg straps and vertical strapping utilizing buckles permanently attached. Elastic looping is fastened to the bottom of the backplane mounting portion. The backplane portion is constructed with a double layer with one vertical side not sewn shut allowing space for storage of flat flexible items such as maps, photographs, instructions, orders and others, with such an edge sealable as by Velcro closure stripping. In some systems one or more bags may be permanently sewn to the backplane and some removeable pouches utilize Velcro type fastening tape attached to the back of pouches for removeable attachment to the backplane covered with mating tape of Velcro type material.

13 Claims, 3 Drawing Sheets

Figure 1:
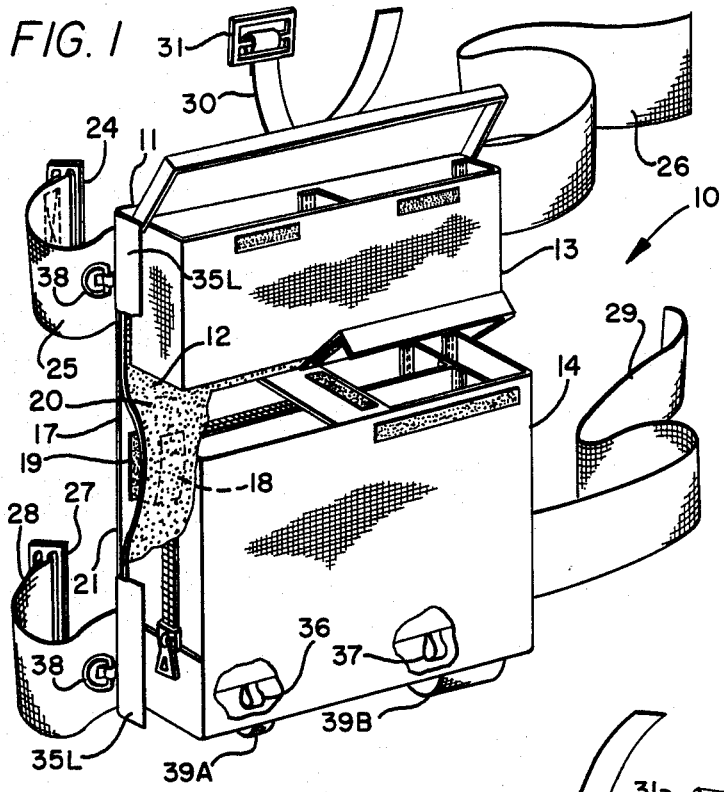

THIGH MOUNTABLE SMALL MODULAR PACK SYSTEM WITH DEMOUNTABLE INTERCHANGEABLE POUCHES

This invention relates in general to field pack carriers, and more particularly, to a thigh mounted small modular pack system with demountable and remountable interchangeable pouches that serve as an alternative carrying method to placing a multitude of small items within shirt, pant and jacket pockets.

In the field hunting, camping, exploring, hiking or in military type use it can be helpful to be able to avoid haphazard placement of a multitude of small items within shirt, pant and jacket pockets not always knowing where certain items are for convenient reliable use when needed. To enhance freedom of movement bulk should be removed from clothing pockets and carried in a convenient readily assessable pack carrier system to further eliminate fumbling for a specific item when it is needed. Provision of a demountable and remountable interchangeable multiple pouch carrier system optimizes pre-organized planned packing of individual pouches for enhanced convenience in use in the field. With such a system pre-packaged pouches would be available for quick replacement of pouches with contents partially or entirely used upon return from the field or from a field supply point or vehicle.

It is therefore, a principal object of this invention to optimize carrying of items in the field of an alternate carrying method to placement of a multitude of small items within shirt, pant and jacket pockets.

Another object is to provide for removal of bulk for clothing pockets with items carried instead in a multi-interchangeable pack system.

A further object is to provide for optimized pre-planned organization of items being carried and for such items to be more conveniently available for use.

Still another object is to provide for quick easy replacement of a used or partially used carrying pouch by an identical pre-packed pouch remountable in place of the removed pouch.

Features of the invention useful in accomplishing the above objects include, in a thigh mountable small modular pack system with demountable and remountable interchangeable pouches, a pack system worn on either thigh held in place with strapping around the thigh and one or more straps connected to a waist belt. While the modular pack system can have one or more pouches it includes removeable and replaceable mounting provision for a plurality of removeable interchangeable pouches. The backplace mounting portion of the pack system on which removeable pouches are mounted is, as a maximum, approximately eight inches by ten inches high having adjustable leg straps and vertical strapping utlizing buckles permanently attached. Elastic looping is fastened to the bottom of the backplane mounting portion, and additional carrying ability is provided by a plurality of "D" rings mounted to leg straps and/or the backplane portion is constructed with a double layer with one vertical side not sewn shut allowing space for storage of flat flexible items such as maps, photographs, instructions, orders and others, with such an edge sealable as by Velcro closure stripping. In some systems one or more bags may be permanently sewn to the backplane and some removeable pouches utilize Velcro type fastening tape attached to the back of pouches for removable attachment to the backplane covered with mating tape of Velcro type material. In addition, vertically extended overlapping side flaps are provided as brush guards to prevent snagging of Velcro attached pouches by brush or tree branches.

Specific embodiments representing what are presently regarded as the best modes of carrying out the invention are illustrated in the accompanying drawings.

Figure 2:
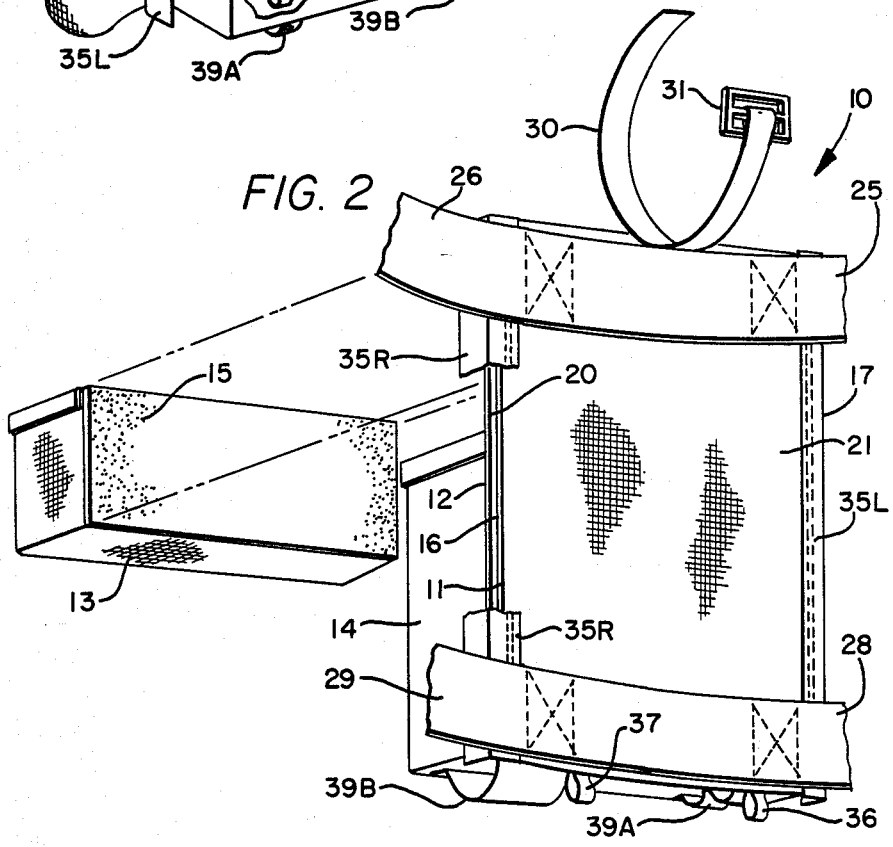
Figure 3:
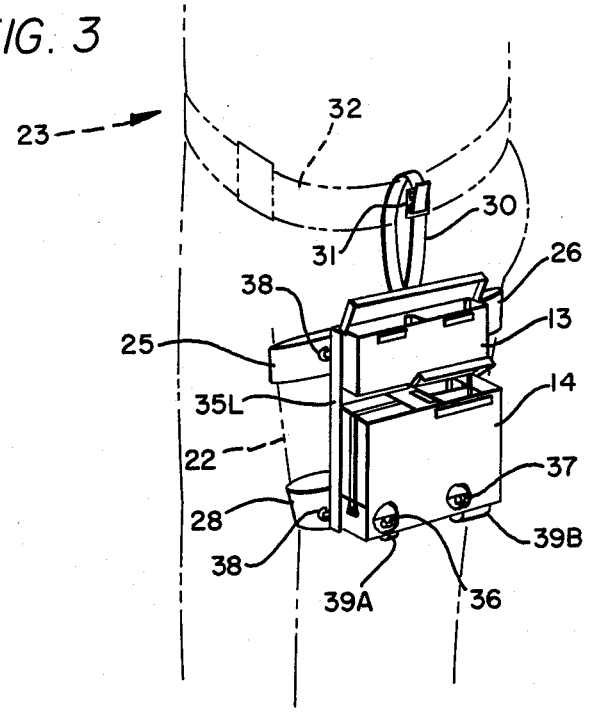
Figure 4:
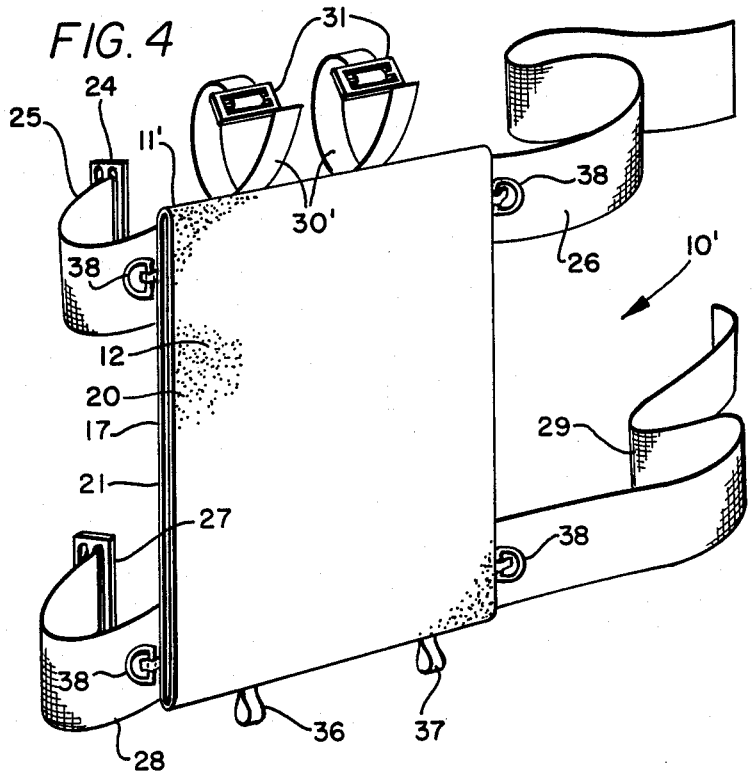
Figure 5:
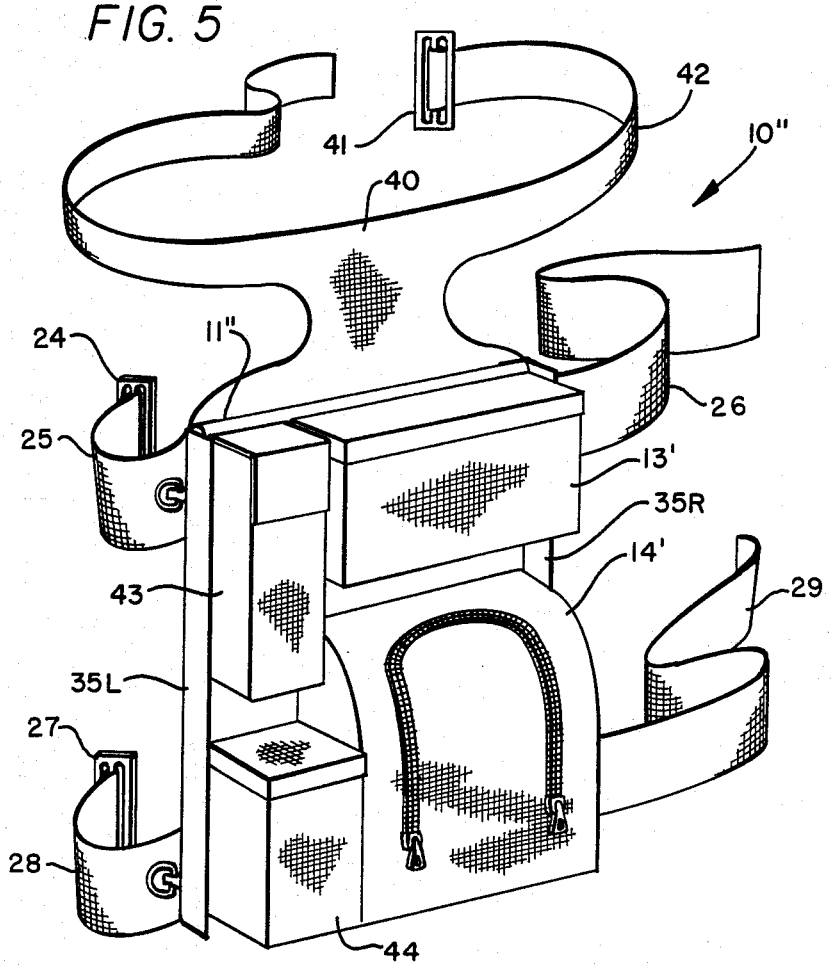

In the drawings:

FIG. 1 represents a perspective view of a thigh mounted small modular pack system with demountable and remountable pouches that are, respectively, interchange with like carrier pouches;

FIG. 2, a partially cut away perspective view of the backplane mounting position with a face of Velcro type material for the supportive removeable mounting of the Velcro mating material backed pouches thereon;

FIG. 3, a perspective showing of the modular pack system embodiment of FIGS. 1 and 2 mounted in place on the left thigh of a user with straps around the leg and a strap at the top around a waist belt;

FIG. 4, a perspective view of the backplane portion of another modular pack system embodiment; and FIG. 5, a perspective view of another modular pack system embodiment.

Referring to the drawings:

The thigh mountable small mountable pack system 10 of FIGS. 1, 2 and 3 is shown to have a backplane portion 11 having Velcro fastener type facing 12 on a backplane outer face for the mounting thereon of multiple demountable and remountable interchangeable pouches 13 and 14 of various sizes. These serve as an alternative carrying method to placing a multitude of small items within shirt, pant and jacket pockets. The backs of pouches 13 and 14 and other interchangeable pouches have a facing 15 of interlocking material that mates in holding relation with the Velcro fastener type facing 12 to hold the pouches 13 and 14 in place on the backplane 11 and yet permit them to be demountable for replacement thereof. The backplane portion 11 of the pack system 10 is in some embodiments made with a double layer with one vertical side edge 16 sewn shut and the other vertical side edge 17 not sewn shut allowing space therein for storage of flat flexible items such as maps, photographs, instructions and order with such an open edge sealable as by Velcro type closure mating strips 18 and 19, respectively, on the inside of Velcro supporting layer 20 and the inside of the thigh side or back layer 21 of the backplane portion 11.

The modular pack system 10 is mounted on the thigh 22 of a person 23 as shown in FIG. 3 held in place by an upper strap with buckle 24 strap section 25 mounted on an upper portion of left edge 17 of the back plane portion 11, and strap section 26 mounted on an upper portion of right edge 16 of backplane 11, and a lower strap with buckle 27 strap section 28 mounted on a lower portion of the left edge 17 of backplane 11 and strap section 29 mounted on a lower portion of the right edge 16 of backplane 11. The upper belt strap 30 with buckle 31 that fastens around belt 32, is long enough that the top strap section 26 is below the users buttox. The double layer backplane portion 11 on the side edge 17 not sewn shut is provided with interlocking material patches 18 and 19 of Velcro action like material as closure means for the backplane 11 pocket. The backplane portion 11 is also provided with opposite side flaps 35L and 35R with the flap 35L extending over the backplane side edge 17 not sewn shut and also as a brush guard along with side flap 35R as a brush guard overlapping that adjacent edge of pouch Velcro interconnect with the backplane.

The backplane portion 11 is provided with elastic loops 36 and 37 at the bottom that may serve as a carrier for a flashlight or other useful items. In addition four "D" rings 38, or more, may be mounted on the backplane 11, as shown, where the mounting straps and the backplane meet, and elsewhere not shown, for lashing or hooking on additional items to be carried. Elastic loops 39A and 39B are provided on the bottom of pack pouch 14 for carrying additional items.

With the backplane 11' embodiment of FIG. 4 two upper belt connecting straps 30' with buckles 31 are provided at the top of the backplane. Opposite side flaps such as side flaps 35L and 35R of FIG. 1, 2 and 3 may be included or not included with this embodiment. Items the same as with the embodiment of FIGS. 1, 2 and 3 are numbered the same without description repeated as a matter of convenience.

Referring now to the embodiment of FIG. 5 the backplane portion 11" is provided with, at the top, an upward projection 40 having a buckle 41 equipped belt 42 as an integral part thereof as an aid to the strapping thereof to a pack system user. This unit is shown with four demountable interchangeable pouches 13', 14', 43 and 44. It should be noted that some pack system embodiments would include fixed in place pouch bags permanently sewn to the backplane along with demountable interchangeable pouches in a combination pack system.

Whereas this invention has been described with respect to several embodiments thereof, it should be realized that various changes may be made without departure from the essential contributions to the art made by the teachings hereof.

I claim:

1. A thigh mountable modular pack system with demountable interchangeable pouches comprising: backplane pack mounting means having a user thigh engaging back side and an outer pouch mounting front side; adjustable length strap means fastened to said backplane pack mounting means for fastening said backplane pack mounting means on a thigh of a user; at least one removable interchangeable pouch having a backing of a first interlocking fastening material of two mating interlocking fastening materials; and a facing of a second interlocking fastening material of said two mating interlocking fastening materials mounted on said outer pouch mounting front side of said backplane pack mounting means, said backing engaged with said facing to mount said pouch on said backplane pack mounted means.

2. The thigh mountable modular pack system with demountable interchangeable pouches of claim 1, wherein said backplane pack mounting means is provided with opposite side edge vertically extended side flaps overlapping adjacent edges of said interlocking material when said pouch is mounted on said backplane pack mounting means.

3. The thigh mountable modular pack system with demountable interchangeable pouches of claim 2, wherein said backplane pack mounting means is provided with upwardly extended fastening means to connect with belt means fastenable around the waist of a user.

4. The thigh mountable modular pack system with demountable interchangeable pouches of claim 3, wherein said backplane pack mounting means is constructed with two layers fastened together around a perimeter of a pack pouch mounting portion and with one side edge left open allowing space for storage of flat flexible items.

5. The thigh mountable modular pack system with demountable interchangeable pouches of claim 4, wherein one of said two layers is part of the back side of said backplane pack mounting means and the other of said two layers is the outer pouch mounting front side.

6. The thigh mountable modular pack system with demountable interchangeable pouches of claim 5, wherein interlocking fastening material patches of two mating interlocking fastening materials are mounted on the insides of said two layers in mating relation between said two layers adjacent said side edges left open as closure means therefore.

7. The thigh mountable modular pack system with demountable interchangeable pouches of claim 5, wherein one of said opposite side edge vertically extended side flaps overlaps said side edge left open between two backplane layers fastened together.

8. The thigh mountable modular pack system with demountable interchangeable pouches of claim 3, wherein said upwardly extended fastening means is at least one upwardly extended strap with buckle means that fastens around a belt worn around the waist of a user.

9. The thigh mountable modular pack system with demountable interchangeable pouches of claim 3, wherein said upwardly extended fastening means is an upward extension having a belt position as an integral part of said upward extension at a top portion of the extension for being fastened around the waist of a user.

10. The thigh mountable modular pack system with demountable interchangeable pouches of claim 3, wherein said adjustable length strap means fastened to said backplane pack mounting means includes, an upper strap fastened to and extending across a top portion of the back side of said backplane means with opposite ends extended for being fastened around the thigh of a user and including strap end fastening means; and a lower strap fastened to and extending across a bottom portion of the back side of said backplane means with opposite ends extended for being fastened around the thigh of a user and including strap end fastening means.

11. The thigh mountable modular pack system with demountable interchangeable pouches of claim 3, wherein said backplane pack mounting means is provided with elastic loop means at a bottom portion thereof for convenience carrying of useful items.

12. The thigh mountable modular pack system with demountable interchangeable pouches of claim 3, wherein elastic loop means is provided on a bottom portion of a removable interchangeable pouch for convenience carrying of useful items.

13. The thigh mountable modular pack system with demountable interchangeable pouches of claim 3, wherein "D" rings are mounted on said backplane pack mounting means for convenience lashing on or hooking on of additional items carried.

* * * * *